US009443469B2

(12) United States Patent
Rohatgi

(10) Patent No.: US 9,443,469 B2
(45) **Date of Patent: *Sep. 13, 2016**

(54) PIXEL CIRCUIT, DRIVING METHOD, DISPLAY DEVICE, AND INSPECTION METHOD

(71) Applicant: Global OLED Technology LLC, Herndon, VA (US)

(72) Inventor: Rajeev Rohatgi, Reno, NV (US)

(73) Assignee: Global OLED Technology LLC, Herndon, VA (US)

( * ) Notice: Subject to any disclaimer, the term of this patent is extended or adjusted under 35 U.S.C. 154(b) by 4 days.

This patent is subject to a terminal disclaimer.

(21) Appl. No.: 14/546,583

(22) Filed: Nov. 18, 2014

(65) Prior Publication Data

US 2015/0145850 A1 May 28, 2015

Related U.S. Application Data

(60) Provisional application No. 61/908,011, filed on Nov. 22, 2013.

(51) Int. Cl.
*G09G 3/32* (2016.01)
*G09G 3/00* (2006.01)

(52) U.S. Cl.
CPC ..... *G09G 3/3233* (2013.01); *G09G 3/006* (2013.01); *G09G 3/3258* (2013.01); *G09G 2300/088* (2013.01); *G09G 2300/0819* (2013.01); *G09G 2300/0842* (2013.01);
(Continued)

(58) Field of Classification Search
CPC ..... G09G 3/30–3/3291; G09G 2300/0439–2300/0465
USPC ..... 345/76–83, 204, 690, 211; 315/169.3
See application file for complete search history.

(56) References Cited

U.S. PATENT DOCUMENTS 6,611,107 B2 8/2003 Mikami et al.
6,771,028 B1 8/2004 Winters
(Continued)

FOREIGN PATENT DOCUMENTS

JP 2003271095 A 9/2001
JP 2004191603 A 7/2004
(Continued)

OTHER PUBLICATIONS

Search Report of European Patent Office in Application No. 10830537.6 (corresponding to U.S. Pat. No. 8,754,882) dated Mar. 1, 2013.
(Continued)

*Primary Examiner* — Stephen Sherman
(74) *Attorney, Agent, or Firm* — Global OLED Technology LLC

(57) ABSTRACT

A circuit is provided to drive a controlled current from a drive transistor into one electroluminescent element of a pixel array. The circuit is operable to compensate for threshold voltage variation of the drive transistor, thereby providing improved image quality. The circuit is suitable for implementation with p-channel MOSFETs and a conventional geometry having in order: substrate, TFT layer(s), anode, electroluminescent layer(s), cathode. A driving method for this circuit is provided. A display incorporating this circuit is provided. The circuit is operable to provide an inspection function prior to fabrication of the electroluminescent layer(s). An inspection method is provided.

7 Claims, 19 Drawing Sheets

(52) U.S. Cl.
CPC ..... *G09G 2300/0866* (2013.01); *G09G 2310/0202* (2013.01); *G09G 2310/0262* (2013.01); *G09G 2320/043* (2013.01); *G09G 2320/045* (2013.01); *G09G 2330/12* (2013.01)

(56) References Cited

U.S. PATENT DOCUMENTS

| | | | | |
|---|---|---|---|---|
| 7,158,105 | B2 * | 1/2007 | Miyazawa | G09G 3/3233 315/169.3 |
| 7,265,572 | B2 | 9/2007 | Osada | |
| 7,518,393 | B2 | 4/2009 | Shirasaki et al. | |
| 7,876,294 | B2 | 1/2011 | Sasaki et al. | |
| 8,138,999 | B2 | 3/2012 | Yamamoto et al. | |
| 8,164,546 | B2 | 4/2012 | Odawara et al. | |
| 8,754,882 | B2 | 6/2014 | Maekawa et al. | |
| 2004/0100203 | A1 | 5/2004 | Kobayashi et al. | |
| 2005/0269959 | A1 | 12/2005 | Uchino et al. | |
| 2006/0113919 | A1 | 6/2006 | Childs et al. | |
| 2006/0119548 | A1 | 6/2006 | Lan et al. | |
| 2006/0119549 | A1 | 6/2006 | Maekawa | |
| 2007/0296672 | A1 | 12/2007 | Kim et al. | |
| 2008/0191976 | A1 | 8/2008 | Nathan et al. | |
| 2008/0238891 | A1 * | 10/2008 | Chiou | G09G 3/3233 345/204 |
| 2009/0096725 | A1 | 4/2009 | Kretz et al. | |
| 2009/0109142 | A1 | 4/2009 | Takahara | |
| 2009/0207105 | A1 | 8/2009 | Hwang et al. | |
| 2009/0213148 | A1 | 8/2009 | Takasugi | |
| 2009/0262258 | A1 | 10/2009 | Taneda et al. | |
| 2010/0181630 | A1 | 7/2010 | Bu et al. | |
| 2011/0050659 | A1 | 3/2011 | Tsai et al. | |
| 2013/0063040 | A1 * | 3/2013 | Huang | G09G 3/3225 315/232 |

FOREIGN PATENT DOCUMENTS

| | | | | |
|---|---|---|---|---|
| JP | 2008052111 | A | 3/2008 | |
| JP | WO 2011059867 | A1 * | 5/2011 | G09G 3/3233 |
| WO | 2004088626 | A1 | 10/2004 | |

OTHER PUBLICATIONS

Office Action of Japanese Patent Office in Application No. 2009-257527 (corresponding to U.S. Pat. No. 8,754,882) dated Feb. 15, 2013.

* cited by examiner

PIXEL CIRCUIT, DRIVING METHOD, DISPLAY DEVICE, AND INSPECTION METHOD

CROSS-REFERENCE TO RELATED APPLICATION

This application claims the benefit of U.S. Provisional Application No. 61/908,011, filed Nov. 22, 2013.

FEDERALLY SPONSORED RESEARCH

Not Applicable

FIELD OF THE INVENTION

The present invention relates to a pixel circuit that drives light emitting elements using a driving transistor, a display device, and an inspection method.

BACKGROUND

Electroluminescent displays, such as organic light emitting diode (OLED) displays, are of increasing interest. Commonly, the pixels of such a display are driven using an active matrix of thin film transistor (TFT) circuits, so that each pixel is independently controlled and can be held in an emissive state for substantially greater than 50% duty cycle.

Unfortunately, such displays are as yet imperfect. Displays may suffer from uneven characteristics across pixels, and may also suffer from aging, thus making it difficult to render a high quality image over the desired lifetime of a display.

One source of variability that is of particular interest is the threshold voltage of a driving transistor. A great many circuits and methods for driving pixels have been proposed to address this and other concerns. U.S. Patent Application Publication 2009/0109142 A1, titled "EL DISPLAY DEVICE," and U.S. Pat. No. 7,876,294, titled "Image display and its control method," describe several such circuits and methods.

Another reference of particular interest is U.S. Patent Application Publication 2013/0016083 A1 by Maekawa and Miwa, titled "Pixel Circuit, Display Device, and Inspection Method." This publication discloses a driving circuit and method of operation that provides threshold voltage compensation and also provides the ability to test the pixel driving transistors before completing the manufacture of the electroluminescent elements of each pixel. An embodiment is shown using n-channel TFTs.

P-channel TFTs are commonly used in the display industry today, although n-channel TFTs can also be fabricated. As organic TFT technology develops, p-channel TFT technology may be preferred, since the materials and processing are different for p-type and n-type materials, and may continue to favor p-type materials over n-type as they do today.

Maekawa also discloses at [0064] a p-channel embodiment where the electroluminescent element is connected on the source side of a p-channel driving transistor, i.e. between positive power supply VCC and the source of the p-channel driving transistor. The Maekawa p-channel embodiment thus requires connecting the source of the driving transistor to the cathode of the electroluminescent element.

Because of the processing temperatures involved, it is common to form TFT layers on a substrate prior to deposition of, for example, delicate organic layers of an OLED electroluminescent element. Within the OLED, indium-tin-oxide (ITO) is a popular anode electrode material. Although lower temperature ITO processes are becoming available, there is still a preference in the display industry to deposit ITO with higher temperature processes that must be performed before OLED deposition.

Another approach to fabricating Maekawa's p-channel embodiment would be to fabricate the OLED in a conventional order, with an anode at the bottom and closest to the TFT layers, and a cathode at the top. Then the connection from driving TFT to the cathode could be made using vias. However this requires additional process steps.

Thus, there is still a need for a p-channel driving circuit and method for an electroluminescent display that compensates for threshold voltage variations, and offers an inspection capability before manufacture of electroluminescent elements has been completed.

BRIEF SUMMARY OF THE INVENTION

A pixel circuit according to the present invention comprises an electroluminescent element such as an OLED driven by current from a p-channel driving TFT. The driving TFT has a storage capacitor connected across source and gate electrodes. Thus, the voltage on the storage capacitor controls the current through the driving TFT and the electroluminescent element. A sampling transistor is controlled by a first scanning line, and connects the gate of the driving TFT to a signal line.

In lieu of a single switching transistor (for example, the transistor 10D used by Maekawa), the pixel circuit according to this invention further comprises a switching transistor controlled by a second scanning line and a shunt transistor controlled by a third scanning line. (In some embodiments, the third scanning line is the same as the first scanning line.) The switching transistor connects a preset potential to the electrode of the storage capacitor away from the sampling transistor. The shunt transistor connects a sink potential to the drain of the driving TFT, thus providing a current path from the drain of the driving TFT that does not require the presence of the electroluminescent element. This current path bypasses the electroluminescent element, if present.

Finally, the pixel circuit incorporates a diode-connected transistor connected between a positive power supply line and the source of the driving TFT. The drain and gate of the diode-connected transistor are connected to the source of the driving TFT, while the source of the diode-connected transistor is connected to the positive power supply. During an emissive phase of operation, this diode-connected transistor operates as a forward-biased diode, passing drive current from the positive power supply to the driving TFT. During other phases of operation, this diode-connected transistor is biased below its conduction threshold, and acts as a high-impedance node so that threshold compensation of the driving TFT can occur.

The horizontal scan period of the display electronics has been known as "1H" since the days of analog television. Following Maekawa, the method of operation of this circuit relies on split cycle operation of the scanning circuitry. A first portion of a plurality of 1H periods is stolen from the normal scanning operation and used to perform operations pertaining to threshold compensation of the driving TFT. The second portion of each 1H period follows a conventional pattern, with data signals being written to each successive row on each successive 1H period.

Seen from the perspective of a single pixel, there are four phases to the circuit operation. The first phase is performed during a first portion of one or more 1H periods, wherein sampling and switching transistors are turned on, and the storage capacitor is preset to a fixed voltage obtained by applying the preset potential and a reference voltage respectively to the two electrodes of the storage capacitor.

The second phase of operation occurs over several 1H periods, as the switching transistor is off, and the forward biased driving transistor discharges the storage capacitor until the voltage across the storage capacitor reaches the threshold voltage of the driving transistor. At this time the driving transistor stops conducting, and the storage capacitor maintains a voltage equal to the threshold voltage for the remainder of the second phase.

The third phase of operation occurs during the second portion of a single 1H period as the sampling transistor is turned on and a display data voltage for the instant pixel is written to the storage capacitor. The display data voltage appears as a voltage step equal to the difference between the display data voltage and the reference voltage. Because the storage capacitor and the diode-connected transistor act as a capacitive voltage divider, a fraction (less than one) of the voltage step is superimposed on the driving transistor threshold voltage previously stored on the storage capacitor.

Finally, the fourth phase of operation occurs, wherein a forward bias on the driving transistor depends on the voltage step, but is independent of the threshold voltage of the driving transistor. During the fourth phase, the sampling transistor, the switching transistor and the shunt transistor are all off. The forward-biased driving transistor draws current from the diode-connected transistor, sinks current into the electroluminescent element, turning both on, whence the pixel emits light dependent on the forward bias of the driving transistor.

A display device according to the present invention comprises an array of pixels organized in rows and columns. In an embodiment, each pixel has a pixel circuit as described above. Each signal line is connected to the pixels of a respective column. Collectively, the signal lines are driven by a column driver circuit.

First and second scanning lines are organized in the row direction and connect to respective rows of pixels. In some embodiments, the second scanning line may be shared between two rows. Collectively, the first scanning lines are driven by a first scan driver circuit. Collectively, the second scanning lines are driven by a second scan driver circuit.

In some embodiments, third scanning lines are the same as the first scanning lines. Where the third and first scanning lines are distinct, the third scanning lines are also organized in the row direction, are connected to respective rows of pixels, and are collectively driven by a third scan driver circuit.

The display device includes a preset potential line for each pixel circuit that may take several forms. A preset potential line may be wired as a row-wise line, as a column-wise line, as a star or tree structure, as a plane, or as a combination of any one or more of these. Where a preset potential line includes a row-wise line, a single row-wise line may be dedicated to a single row of pixels, or it may be shared among two or more rows of pixels. Where a preset potential line includes a column-wise line, a single column-wise line may be dedicated to a single column of pixels, or it may be shared among two or more columns of pixels.

In some embodiments, the sink potential line for each pixel circuit is the same as the third scanning line. Where the third scanning line and the sink potential line are distinct, the sink potential line may be wired as a row-wise line, as a column-wise line, as a star or tree structure, as a plane, or as a combination of any one or more of these. Where the sink potential line includes a row-wise line, a single row-wise line may be dedicated to a single row of pixels, or it may be shared among two or more rows of pixels. Where the sink potential line includes a column-wise line, a single column-wise line may be dedicated to a single column of pixels, or it may be shared among two or more columns of pixels.

The display device may include one or more test points, to enable measurement by external testing equipment during and after manufacture. A test point may be connected to one or more of the preset potential lines. Alternatively or additionally, a test point may be connected to one or more of the sink potential lines.

By suitable control of the transistors of a first pixel circuit associated with a first pixel, a current path through the first pixel circuit can be formed from an associated preset potential line, through switching transistor, driving transistor, and shunt transistor, to an associated sink potential line. This current path is independent of the light emitting element, and can be used to test the first pixel circuit, in particular the driving transistor of the first pixel circuit, prior to manufacture of the light emitting element.

For example, by suitable control of the scanning control lines and the signal line associated with the first pixel circuit, a known test voltage can be applied across the storage capacitor of the first pixel circuit. Other pixel circuits can be controlled so that the driving transistors of these other pixel circuits are biased in cut-off, so that the current flowing from the associated preset potential line to the associated sink potential line flows entirely through the first pixel circuit.

For inspection of the display device, a test point connected to a potential line (sink or preset potential line) may be connected through an ammeter to a potential source. Thus the potential line is powered through the test point's external connection, and is not powered by any internal connection used during normal operation of the display device.

By suitable application of a sequence of known test voltages to the storage capacitor of the first pixel circuit, and corresponding measurement of the driving transistor current by the ammeter, the I-V characteristic of the driving transistor can be determined, even before manufacture of the display device is complete. Thereby, a defective pixel circuit can be determined.

Testing of a single pixel circuit can be terminated early, for example if a measured current is out of range and the associated pixel can already be identified as having a defective pixel circuit.

The test of the first pixel circuit may be followed by a test of a second pixel circuit. A succession of pixel circuits may be tested one at a time, in such a manner as to cover all pixels of the display device, a sampling of the pixels of the display device, or until such time as a predetermined number of defective pixel circuits have been found.

When a defective pixel circuit is found, different actions can be taken. The defective circuit can be flagged for downstream calibration or compensation, and the manufacturing process can proceed normally. If the defective pixel circuit is on a mother substrate that will later be singulated into multiple discrete panels associated with respective display devices, then the panel containing the defective pixel circuit can be flagged as defective and discarded after singulation. Alternatively, the entire substrate containing the defective pixel substrate can be withdrawn from the manufacturing line. In some situations, repair of the defective pixel may be undertaken.

The test point may also be used after the light emitting elements have been fabricated, and after manufacture of the display device is complete. The test point may also be used to test groups of pixels together, rather than one pixel at a time. In embodiments having multiple test points, multiple pixel circuits may be tested simultaneously, thereby shortening the time required for inspection of a display device.

DETAILED DESCRIPTION OF THE INVENTION

Display Device

Figure 1:
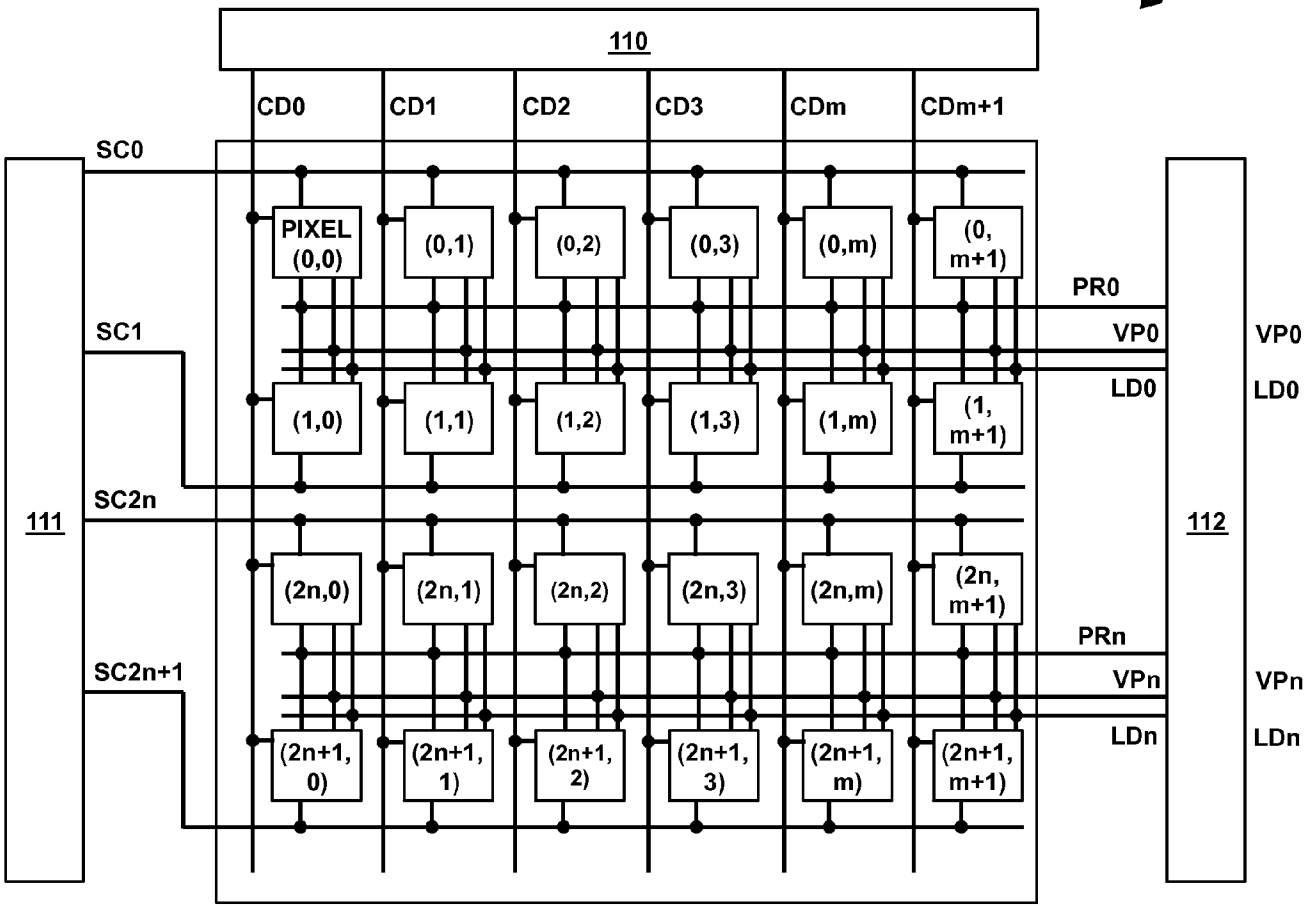
FIG. 1 is a block diagram of a display device according to the present invention.

FIG. 1 shows a block diagram of a display device 100 according to one embodiment of the present invention. The display device an array of pixels organized in rows and columns. Rows are numbered from 0 to 2n+1, while columns are numbered from 0 to m. Pixels are designated as (row, column), so pixel(0,0) indicates the pixel at row 0, column 0, and (2n,3) is shorthand notation for the pixel at row 2n, column 3.

In the embodiment shown, each pixel is connected to a column-wise signal line so that each pixel in column 2 is connected to a shared signal line labeled CD2. In general, each pixel in column j is connected to shared signal line CDj. The signal lines are collectively driven by signal driver circuit 110. Signal driver circuit 110 may be implemented by on-substrate circuitry and may use the same manufacturing process as TFT circuits within each pixel. Alternatively signal driver circuit 110 may be implemented by one or more discrete integrated circuits that are attached to a substrate of the display device, or a combination of discrete integrated circuits and on-substrate circuitry.

In this embodiment, each pixel is further connected to first and second scanning lines that are arranged in the row-wise direction. Each pixel in row 1 is connected to first scanning line SC1, which is shared by all pixels in row 1. In general, each pixel in row k is connected to first scanning line SCk. In this embodiment, pixels in two adjacent rows share a common second scanning line, so that all pixels in rows 2n and 2n+1 are connected to second scanning line PRn. In general each pixel in row k is connected to second scanning line PR⌊k/2⌋, where the symbols ⌊ ⌋ designate the integer floor function. The first scanning lines are driven by first scan driver circuit 111. The second scanning lines are driven by second scan driver circuit 112.

Each pixel in row 0 is further connected to a preset potential line VP0 and to a sink potential line LD0. In the embodiment shown, the preset potential lines and sink potential lines are arranged row-wise and shared among all pixels of two adjacent rows. Thus, in this embodiment, each pixel in row k is connected to preset potential line VP⌊k/2⌋ and sink potential line LD⌊k/2⌋.

In some embodiments, all the pixel circuits may be connected to the same potential VP on their respective preset potential lines. Therefore, the preset potential lines may all be connected together. Also, the preset potential lines may be laid out in alternative configurations. The preset potential lines may be laid out as column-wise lines, as planes, as stars or trees, or as any combination of these elements. A combination of column-wise lines and row-wise lines may form a mesh.

In some embodiments, all the pixel circuits may be connected to the same potential LD on their respective sink potential lines. Therefore, the sink potential lines may all be connected together. Also, the sink potential lines may be laid out in a similar variety of configurations as for the preset potential lines.

In some embodiments, third scanning lines are provided, distinct from the first and second scanning lines. The third scanning lines may be laid out in the row-wise direction, and each third scanning line may be shared by some or all pixels in one or more rows. The third scanning lines are driven by a third scan driver circuit (not shown).

Pixel Circuit

Figure 2:
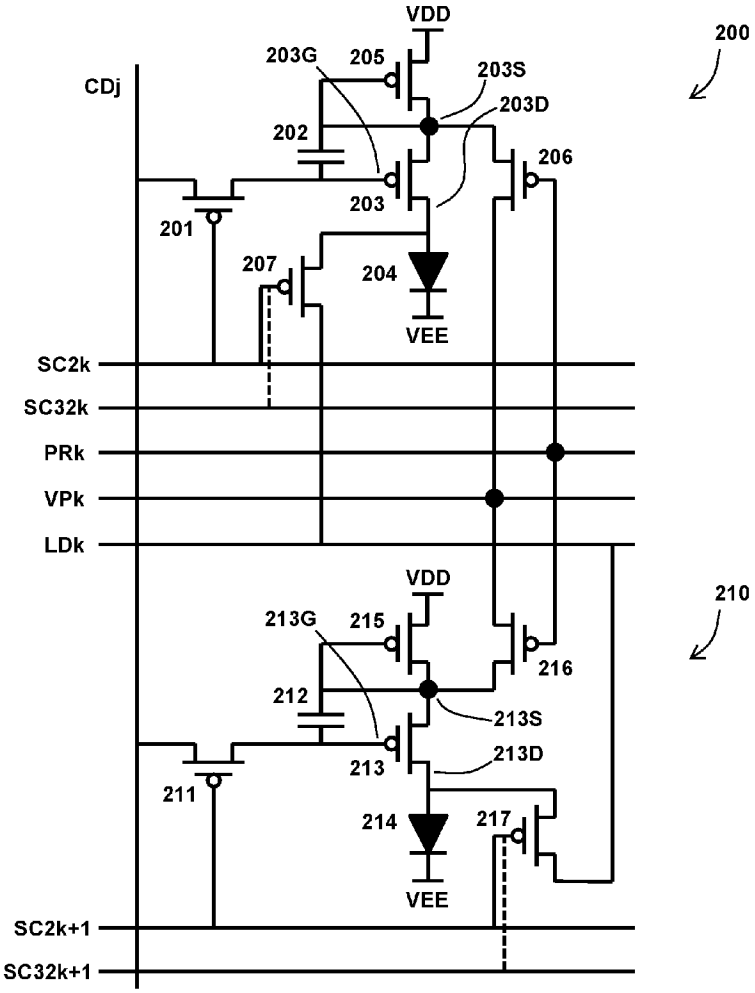
FIG. 2 is a pixel circuit of the present invention.

FIG. 2 shows pixel circuit 200 for a pixel at row 2k, column j, and pixel circuit 210 for an adjacent pixel at row 2k+1, column j. In the embodiment shown, the second scanning line PRk, the preset potential line VPk, and the sink potential line LDk are all shared between pixels in row 2k and row 2k+1, which includes the two pixels shown. Since the two pixels are in the same column j, they also share signal line CDj.

Storage capacitor 202 is connected across gate electrode and source electrode of driving transistor 203. The circuit nodes connected to gate, source, and drain of driving transistor 203 are denoted 203G, 203S, and 203D respectively. Sampling transistor 201 and switching transistor 206 are controlled by first scanning line SC2*k* and second scanning line PRk respectively. When in a conducting state, these transistors allow voltages from the signal line CDj and the preset potential line VPk to be applied directly to nodes 203G and 203S respectively, and thereby to electrodes of storage capacitor 202.

Diode-connected transistor 205 is connected between first power supply line VDD and node 203S. During one or more phases of operation, the transistor 205 may be forward biased and may therefore conduct current. During one or more other phases of operation, the transistor 205 may be in a non-conducting or cutoff state, and may be treated as a capacitor or a high-impedance circuit element.

Light emitting element 204 is connected between node 203D and a second power supply line VEE. Light emitting element 204 may be an organic light emitting diode (OLED) and may emit light when current flows through it.

Shunt transistor 207 is connected to provide a current path between node 203D and the sink potential line LDk. This transistor provides a current path that bypasses the light emitting element 204 thereby to allow one or more phases of operation of the pixel circuit 200 without emission of unwanted light. Shunt transistor 207 also provides a current path from node 203D that is available before the light emitting element 204 is manufactured, whereby the driving transistor 203 is operable for testing during the manufacturing process.

In the embodiment shown, the gate of shunt transistor 207 is controlled by first scanning line SC2*k*. In other embodiments, the gate of shunt transistor 207 may be controlled by a separate third scanning line SC32*k* (connection shown as dashed in FIG. 2). In some embodiments, the third scanning line may be combined with a sink potential line LD, thereby rendering shunt transistor 207 to operate as a diode instead of as a switch.

The elements of pixel circuit 210 are analogous to the elements of pixel circuit 200 described above.

Driving Method

The operation of pixel circuits 200 and 210 will be described with the help of FIG. 3 and FIGS. 4A-4K. The embodiment described herein has second scanning lines shared between adjacent rows of pixels. The embodiment described herein has third scanning lines being the same as first scanning lines, which means that shunt transistor 207 and sampling transistor 201 turn on and off together as shown in FIGS. 4A-4K. This embodiment is described to show operability with shared lines, allowing a display device to be built with less total lines and driving circuitry than if each row were to have three distinct scanning lines, or if each row were to have scanning lines separate from any other row. It will be apparent to one skilled in the art how to make a display device embodiment with more scanning lines, and how the operation sequence may be varied for such an embodiment, without departing from the spirit and scope of this invention.

Figure 3:
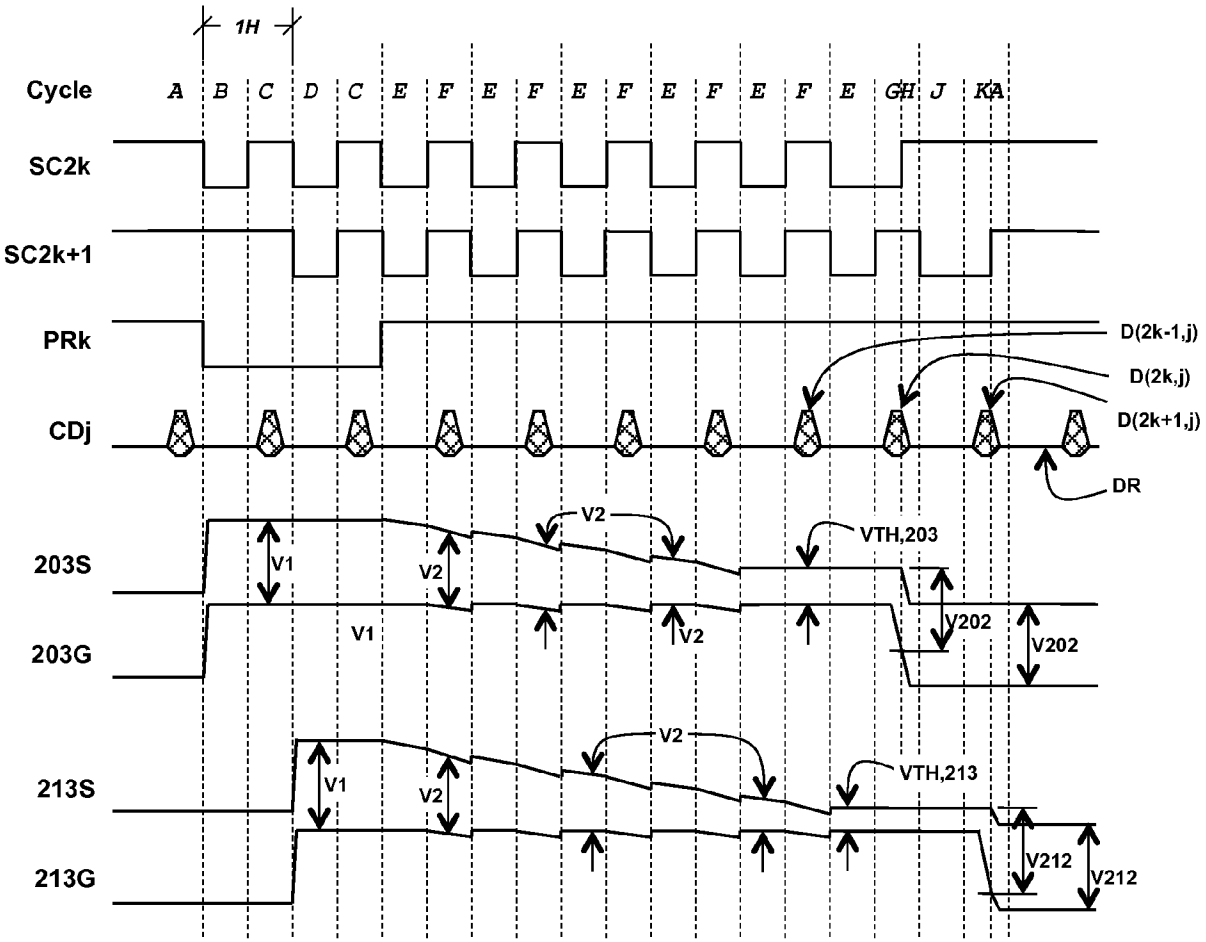
FIG. 3 shows operating waveforms of the present invention.

Time is represented on the horizontal axis of FIG. 3, with voltage being represented on the vertical axis. (The axes are not explicitly shown in FIG. 3.) Time is divided into horizontal scan periods of uniform width denoted as 1H. For the purpose of discussion, the 1H periods are aligned as shown at the top of FIG. 3. The driving method of this invention relies on split cycle operation of multiple 1H periods. For example, the 1H period indicated at the top of FIG. 3 is split into a first B cycle and a second C cycle. Similarly, other 1H periods may likewise be considered to comprise a first cycle that precedes a second cycle. It will be observed towards the right-hand side of FIG. 3 that some 1H periods comprise three cycles, such as {E, G, H} and {J, K, A}.

Examination of the waveform for signal line CDj shows a constant voltage DR applied to signal line CDj during each first cycle, and variable data voltage applied to the signal line CDj during each second cycle. In the embodiment to be described, the variable data voltage applied during successive 1H periods corresponds to image pixel data written to the pixel circuits of successive rows of column j, in a conventional sequential scan as widely practiced in the art. By way of example, the data voltage for three successive 1H periods is labeled as D(2k−1,j), D(2k,j), and D(2k+1,j), where D(p,q) denotes a voltage corresponding to image pixel data for the pixel circuit at row p, column q.

Figure 4A:
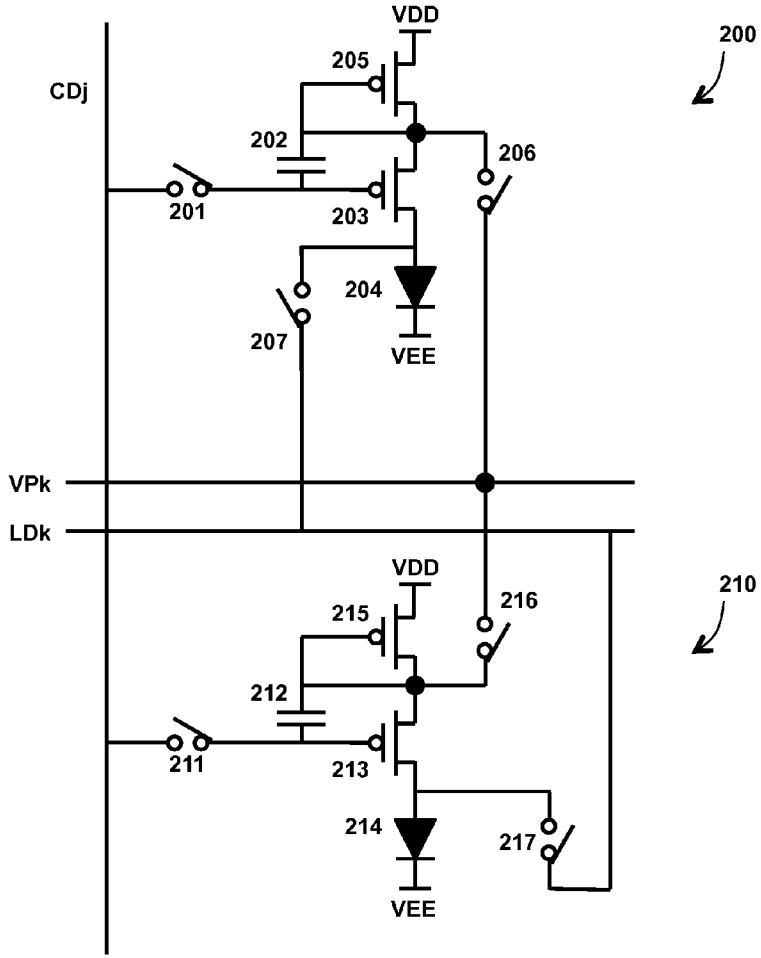
FIG. 4A is an explanatory diagram of the present invention.

The description of the operation of pixel circuits 200 and 210 begins with cycle A, which represents a normal emission state of the pixel, and is shown on FIG. 3 with pixel circuits configured according to FIG. 4A. During this cycle, sampling transistors 201, 211, switching transistors 206, 216, and shunt transistors 207, 217 are all configured in respective non-conducting states. Operation of pixel circuits 200, 210 is thus determined by the voltages stored on storage capacitors 202, 212, which voltages control the bias of respective driving transistors 203, 213. Accordingly, current flows through forward-biased diode-connected transistors 205, 215, driving transistors 203, 213, and light emitting elements 204, 214, resulting in emission of light as programmed. Note that since sampling transistors 201, 211 are non-conducting, the pixel circuits 200, 210 are unaffected by activity on signal line CDj, as data voltages are written to other rows. The pixel circuits 200, 210 may commonly be in the configuration of cycle A for a substantial majority of the frame period. Elsewhere in this description, cycle A is described as a fourth phase of pixel circuit operation.

Figure 4B:
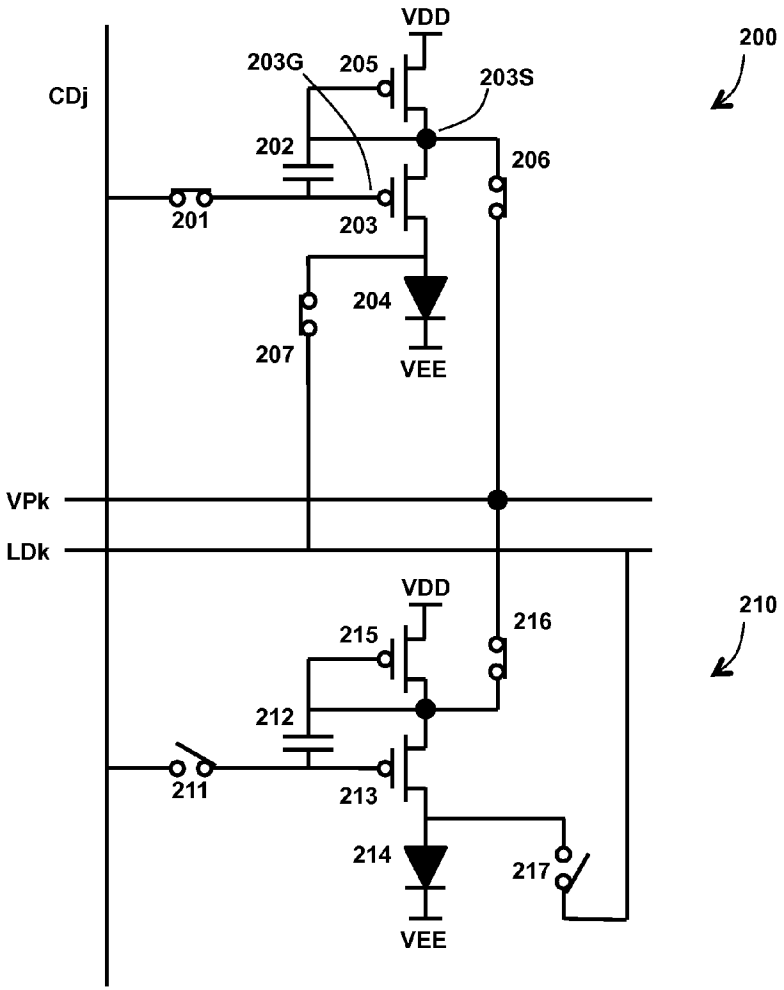
FIG. 4B is an explanatory diagram of the present invention.

Cycles B and D comprise a first phase of pixel circuit operation and are described next. The configurations for pixel circuits 200, 210 are shown in FIG. 4B for cycle B and in FIG. 4D for cycle D. As drawn in FIG. 3, scanning line signals SC2*k*, SC2*k*+1, PRk are all depicted as active-low signals, which is consistent with controlling p-channel MOSFETs as are used in many embodiments of this invention. Second scanning line PRk is activated for two consecutive 1H scan periods, thereby setting switching transistors 206, 216 into respective conducting states. Concurrently, during cycle B, first scanning line SC2*k* is activated, turning on sampling transistor 201 as shown in FIG. 4B. During cycle D, both first scanning lines SC2*k* and SC2*k*+1 are activated, turning on both sampling transistors 201, 211 as shown in FIG. 4D. With sampling transistor 201 turned on, reference voltage DR is written to node 203G, while preset potential VP from preset potential line VPk is written to node 203S. Thus, a voltage (VP−DR)=V1 is preset on storage capacitor 202. Similarly, the same voltage (VP−DR)=V1 is preset on storage capacitor 212 during cycle D.

Voltages VP, DR, and LD are chosen so that the following relationships are satisfied:

$$(VDD-VP)<V_{TH,205} \quad \text{(B1)}$$

$$(VDD-VP)<V_{TH,215} \quad \text{(D1)}$$

$$(VP-DR)>V_{TH,203} \quad \text{(B2)}$$

$$(VP-DR)>V_{TH,213} \quad \text{(D2)}$$

$$(LD-VEE)<V_{TH,204} \quad \text{(B3)}$$

$$(LD-VEE)<V_{TH,214} \quad \text{(D3)}$$

where $V_{TH,NNN}$ denotes the threshold voltage of a circuit element whose reference designator is NNN. Relationships B1, B3, D1, D3 indicate that diode-connected transistor 205, 215 and light emitting elements 204, 214 are in respective non-conducting states, while relationships B2, D2 indicate that driving transistors 203, 213 are in respective conducting states.

Figure 4C:
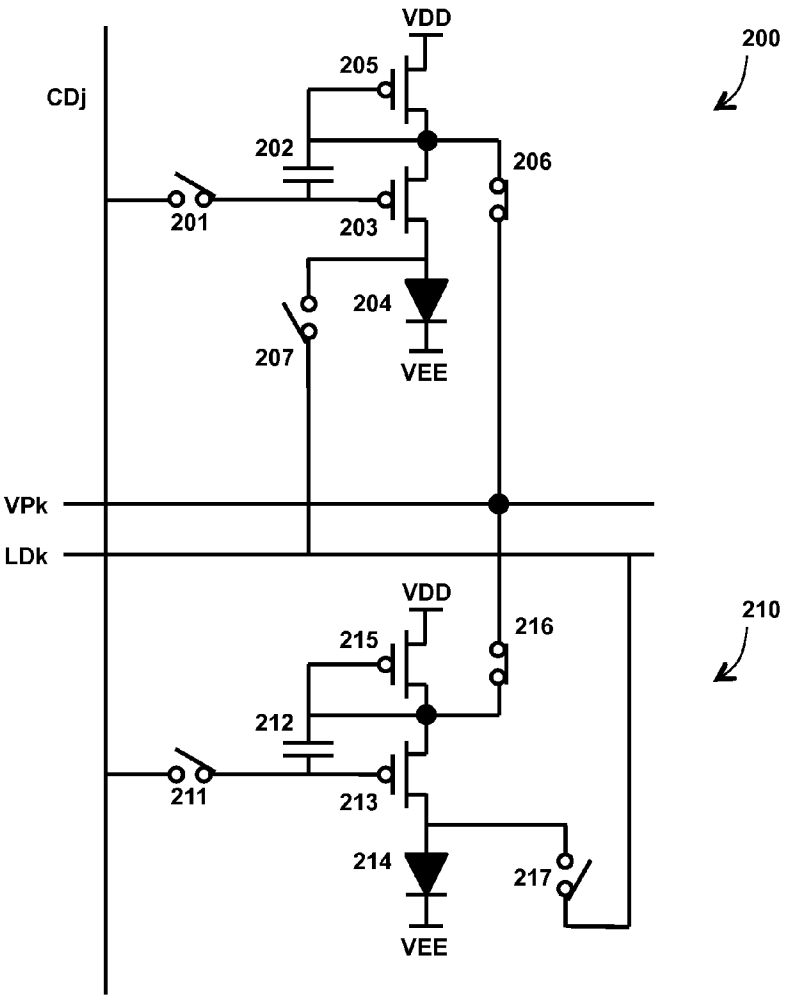
FIG. 4C is an explanatory diagram of the present invention.
Figure 4D:
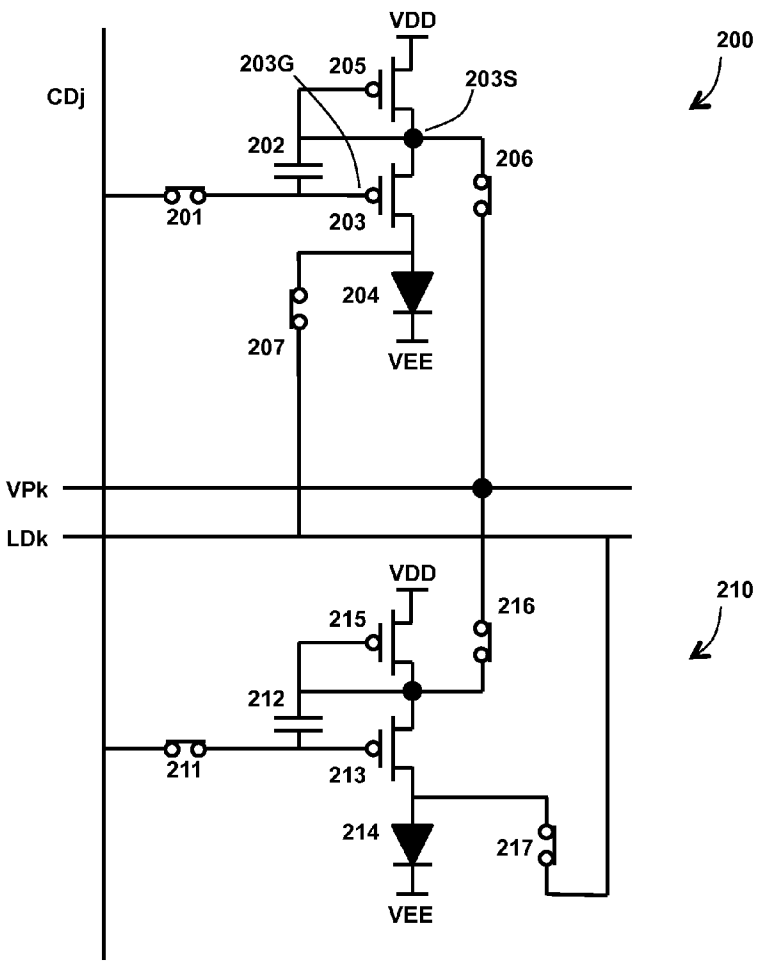
FIG. 4D is an explanatory diagram of the present invention.

Following each of cycles B and D is a cycle C, shown in FIG. 3, with pixel circuits 200, 210 in configurations shown in FIG. 4C. During these cycles, data voltages for other rows are present on signal line CDj, and sampling transistors 201, 211 are set to respective non-conducting states so that pixel circuits 200, 210 are not affected by data on the CDj line. With common scanning control lines for sampling transistors 201, 211 and shunt transistors 207, 217, it follows that shunt transistors 207, 217 are also non-conducting during cycle C. Other embodiments having separate control for shunt transistors 207, 217 and sampling transistors 201, 211 may retain shunt transistors 207, 217 in respective conducting states during cycle C.

The first phase of pixel circuit operation results in presetting of storage capacitors 202, 212, in a manner that is unaffected by accompanying cycles C.

Figure 4E:
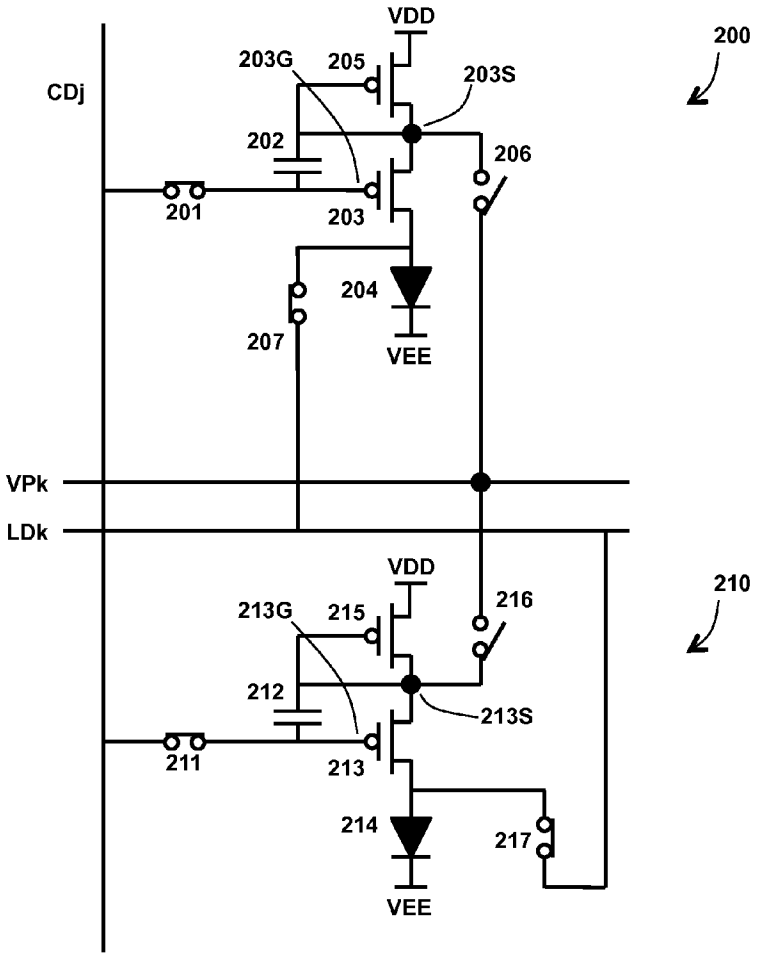
FIG. 4E is an explanatory diagram of the present invention.
Figure 4F:
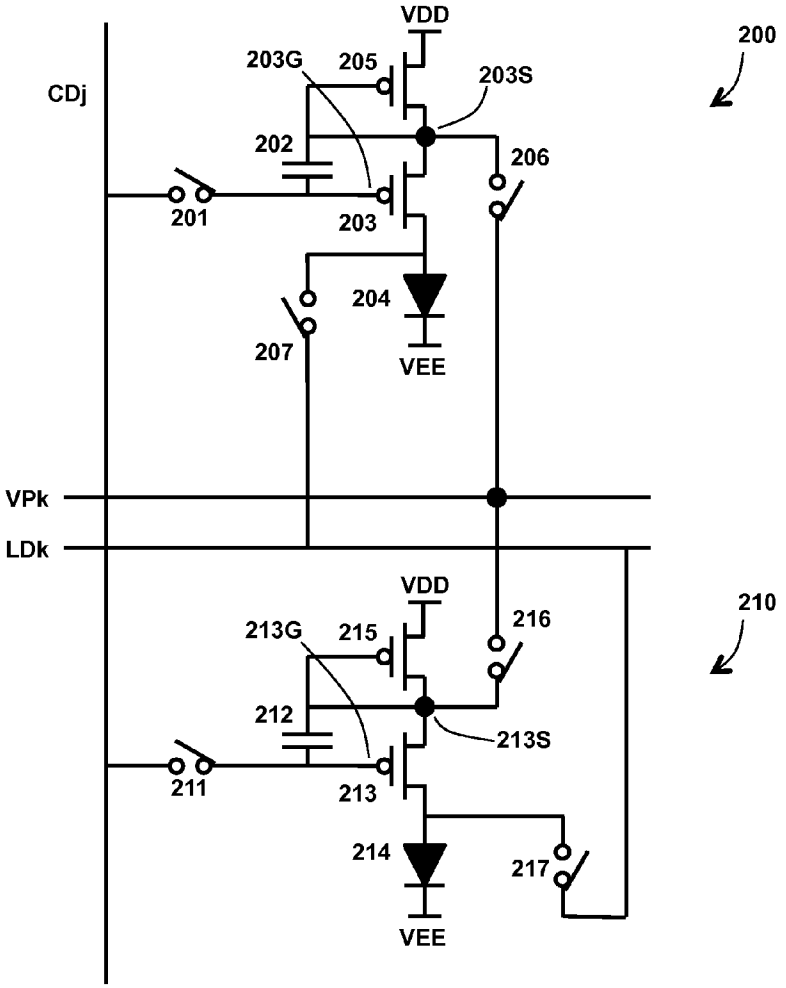
FIG. 4F is an explanatory diagram of the present invention.

The description of the operation of pixel circuits 200, 210 continues with cycles E and F, shown in FIG. 3 with respective pixel circuit configurations shown in FIGS. 4E and 4F. As the first phase of pixel circuit operation leaves the driving transistors 203, 213 in respective conducting states, current flows through the driving transistors 203, 213. Since switching transistors 206, 216 are both non-conducting during cycles E and F, this current is drawn from nodes 203S, 213S respectively. This causes the voltages of nodes 203S, 213S to be lowered as shown in FIG. 3.

During cycle E, sampling transistors 201, 211 are in respective conducting states, and the nodes 203G, 213G are held at reference voltage DR. So, as the voltage of nodes 203S, 213S is lowered, the voltages on storage capacitors 202, 212 is gradually reduced, approaching the respective threshold voltages of driving transistors 203, 213. The gradually reducing voltage on storage capacitors 202, 212 is indicated as V2 in FIG. 3. The threshold voltages $V_{TH,203}$ and $V_{TH,213}$ of driving transistors 203, 213 are also shown in FIG. 3.

During cycle F, sampling transistors 201, 211 are held in respective non-conducting states so that pixel circuits 200, 210 are unaffected by data voltages on the signal line CDj. Therefore nodes 203G, 213G are at high impedance and the storage capacitors 202, 212 cannot be discharged during cycle F. Any current drawn by the driving transistors 203, 213 during cycle F must come from diode-connected transistors 205, 215.

As shown in FIG. 3, the voltages on storage capacitors 202, 212 are drawn down to the respective threshold voltages of driving transistors 203, 213 over a number of cycles E. Correspondingly, the current flowing through driving transistors 203, 213 reduces substantially to zero.

Cycles E comprise a second phase of pixel circuit operation, and result in the threshold voltages of driving transistors 203, 213 being stored in respective storage capacitors 202, 212.

Circuit parameters are chosen so that the following relationships are satisfied through the end of the second phase:

$$(VDD-VP)<V_{TH,205} \quad \text{(E1)}$$

$$(VDD-VP)<V_{TH,215} \quad \text{(E2)}$$

$$(VP-DR)>V_{TH,203} \quad \text{(E3)}$$

$$(VP-DR)>V_{TH,213} \quad \text{(E4)}$$

$$(LD-VEE)<V_{TH,204} \quad \text{(E5)}$$

$$(LD-VEE)<V_{TH,214} \quad \text{(E6)}$$

Figure 4G:
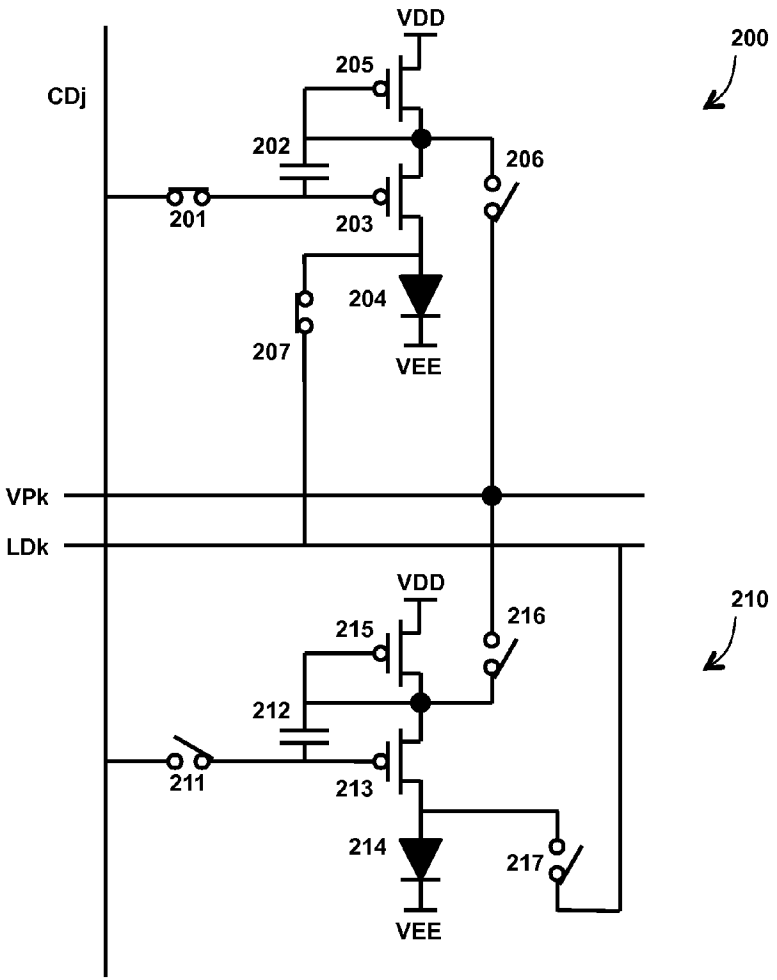
FIG. 4G is an explanatory diagram of the present invention.

The description of the operation of pixel circuits 200, 210 continues with cycle G, indicated in FIG. 3, with a configuration of pixel circuits 200, 210 shown in FIG. 4G. Cycle G is the second cycle of a 1H period, during which voltage D(2k,j) representing a data signal for row 2k is provided on signal line CDj. Switching transistors 206, 216 are both configured to be in respective non-conducting states. Sampling transistor 211 is configured to be in a non-conducting state, similar to cycle F, so that pixel circuit 211 remains unaffected by the data signal on signal line CDj. Pixel circuit 210 remains in a quiescent state, with storage capacitor 212 holding a voltage equal to the threshold voltage of driving transistor 213. Substantially no current flows through driving transistor 213, and the voltages of all three electrodes of driving transistor 213 remain substantially unchanged.

In contrast, sampling transistor 201 is configured to be in a conducting state, whereby node 203G is set to the voltage D(2k,j), which represents image data for pixel circuit 200. Previously node 203G had been at voltage DR. Thus, a voltage step D(2k,j)−DR is applied to node 203G. Because sampling transistor 206 and diode-connected transistor 205 are both non-conducting, and driving transistor 203 is biased at its threshold voltage, the combined load seen looking in from signal line CDj is that of a capacitive voltage divider substantially formed by storage capacitor 202 and diode-connected transistor 205. The fraction of the voltage step appearing across storage capacitor 202 is given by C205/(C202+C205), where CNNN denotes the capacitance of a circuit element having reference designator NNN.

Prior to cycle G, the voltage across the storage capacitor 202 was $V_{TH,203}$, the threshold voltage of driving transistor 203. Applying the principle of superposition, the resulting voltage V202 (also shown in FIG. 3) across the storage capacitor 202 is given by $$V_{202}=V_{TH,203}+(DR-D(2k,j))\times C_{205}/(C_{202}+C_{205}) \quad \text{(G1)}$$

In the saturation region, the drain current Ids of a p-channel MOSFET can be expressed as $$Ids=\tfrac{1}{2}Kn(Vsg-Vth)^2 \quad \text{(G2)}$$

where Kn is known as the transconductance parameter of the MOSFET, Vsg is the source to gate voltage drop of the MOSFET, and Vth is the threshold voltage of the MOSFET. For the driving transistor 203, Vsg=V202 and Vth=$V_{TH,203}$, so the drain current I203 through the driving transistor 203 is found to be $$I_{203}=\tfrac{1}{2}Kn[(DR-D(2k,j))\times C_{205}/(C_{202}+C_{205})]^2 \quad \text{(G3)}$$

which is independent of $V_{TH,203}$, showing that the threshold voltage of the driving transistor has been compensated.

Cycle G is a third phase of operation for pixel circuit 200.

With common scanning control lines for sampling transistors 201, 211 and shunt transistors 207, 217, it follows that shunt transistor 207 is in a conducting state during cycle G, while shunt transistor 217 is in a non-conducting state. Other embodiments having separate control for shunt transistors 207, 217 and sampling transistors 201, 211 may have shunt transistor 207 configured to be in a non-conducting state during cycle G.

Figure 4H:
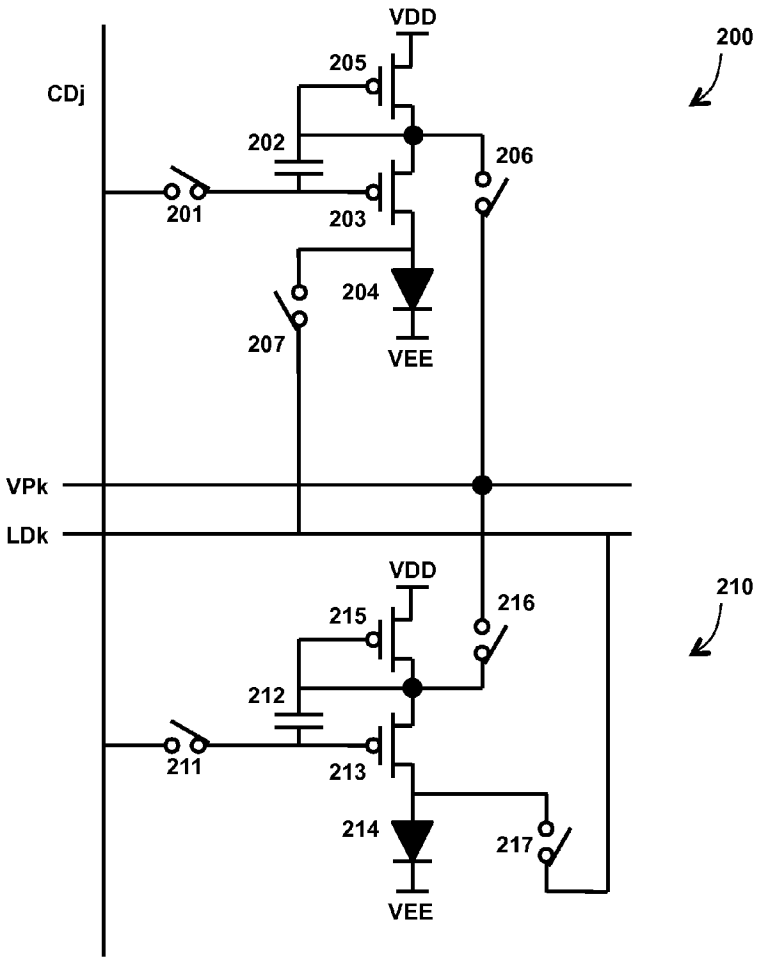
FIG. 4H is an explanatory diagram of the present invention.

The description of the operation of pixel circuits 200, 210 continues with cycle H, indicated in FIG. 3, with a configuration of pixel circuits 200, 210 shown in FIG. 4H. Sampling transistor 201 is configured to be in a non-conducting state, so that the voltage on the storage capacitor 202 is held steady. Unless the data signal for pixel circuit 200 corresponds to a black level, the voltage V202 on the storage capacitor 200 will forward bias the driving transistor 203, causing current I203 to flow through driving transistor 203. This current is sourced from diode-connected transistor 205, and causes voltage across diode-connected transistor 205 to increase. As the voltage across diode-connected transistor 205 increases past the threshold voltage $V_{TH,205}$ of diode-connected transistor 205, diode-connected transistor 205 transitions to a conducting state. Similarly, the current I203 through driving transistor 203 flows into light emitting element 204, causing the voltage across light emitting element 204 to increase. As the voltage across light emitting element 204 increases past the threshold voltage $V_{TH,204}$ of light emitting element 204, the light emitting element 204 transitions to a conducting state and emits light. The fourth phase of operation begins for pixel circuit 200 in cycle H.

During cycle H, pixel circuit 211 remains in a quiescent state, unchanged from cycle G.

Figure 4J:
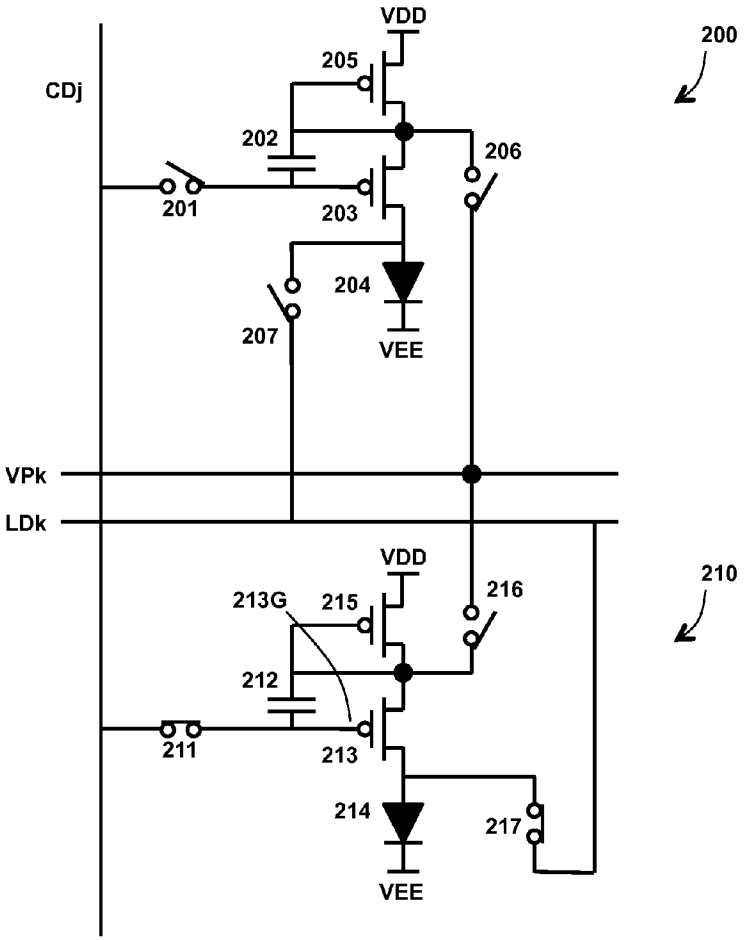
FIG. 4J is an explanatory diagram of the present invention.

The description of the operation of pixel circuits 200, 210 continues with cycle J, indicated in FIG. 3, with a configuration of pixel circuits 200, 210 shown in FIG. 4J. Pixel circuit 200 remains in an active emitting state, unchanged from cycle H. Pixel circuit 210 meanwhile is in the same state as for cycle E. Node 213G is held at voltage DR from the signal line CDj, and the storage capacitor 212 retains a voltage equal to the threshold voltage $V_{TH,213}$ of driving transistor 213.

Figure 4K:
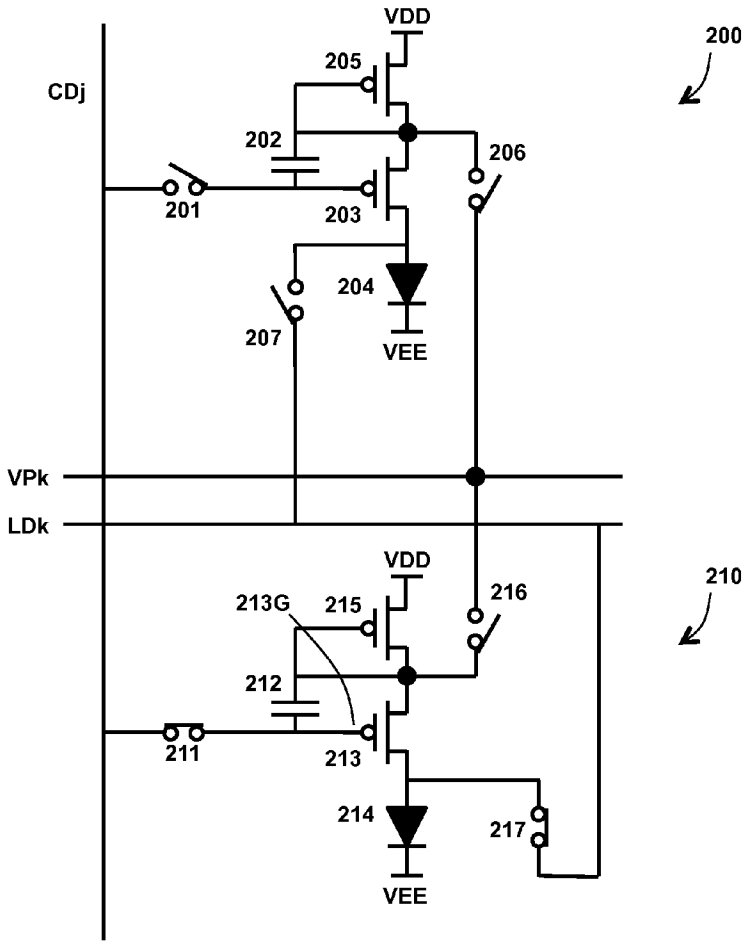
FIG. 4K is an explanatory diagram of the present invention.

The description of the operation of pixel circuits 200, 210 continues with cycle K, indicated in FIG. 3, with a configuration of pixel circuits 200, 210 shown in FIG. 4K. Pixel circuit 200 remains in an active emitting state, unchanged from cycle H. Meanwhile voltage D(2k+1,j) representing a data signal for row 2k+1 is provided on signal line CDj. In pixel circuit 210, sampling transistor 211 is configured to be in a conducting state, and a voltage step from the previous voltage DR to the new voltage D(2k+1,j) is applied to node 213G. The operation of pixel circuit 210 during cycle K is analogous to the operation of pixel circuit 200 during cycle G, which has been described above. Cycle K is a third phase of operation for pixel circuit 210. The resulting voltage V212 (also shown in FIG. 3) across the storage capacitor 212 is given by $$V_{212}=V_{TH,213}+(DR-D(2k+1,j))\times C_{215}/(C_{212}+C_{215}) \quad \text{(K1)}$$

The resulting drain current I213 through the driving transistor 213 is found to be $$I_{213}=\tfrac{1}{2}Kn[(DR-D(2k+1,j))\times C_{215}/(C_{212}+C_{215})]^2 \quad \text{(K2)}$$

Following cycle K is cycle A, indicated in FIG. 3 and with pixel circuits 200, 210 configured according to FIG. 4A. Pixel circuit 210 enters an active emitting state (the fourth phase of operation) during this cycle A (immediately following cycle K), analogous to the previous description of pixel circuit 200 during cycle H. Pixel circuit 200 maintains its active emitting state as described above in context of initial cycle A and cycle J.

In the embodiment described, the pixel circuits maintain a succession of cycles A for the bulk of the frame period, i.e. until a few 1H periods before data D(2k,j) is next provided on the CDj signal line. In other embodiments, the light emission may be gated, or other cycles introduced, without departing from the spirit and scope of this invention.

It will be apparent to one skilled in the art that details of circuit operation will depend on the exact values of circuit parameters illustrated.

Inspection Method

Figure 5:
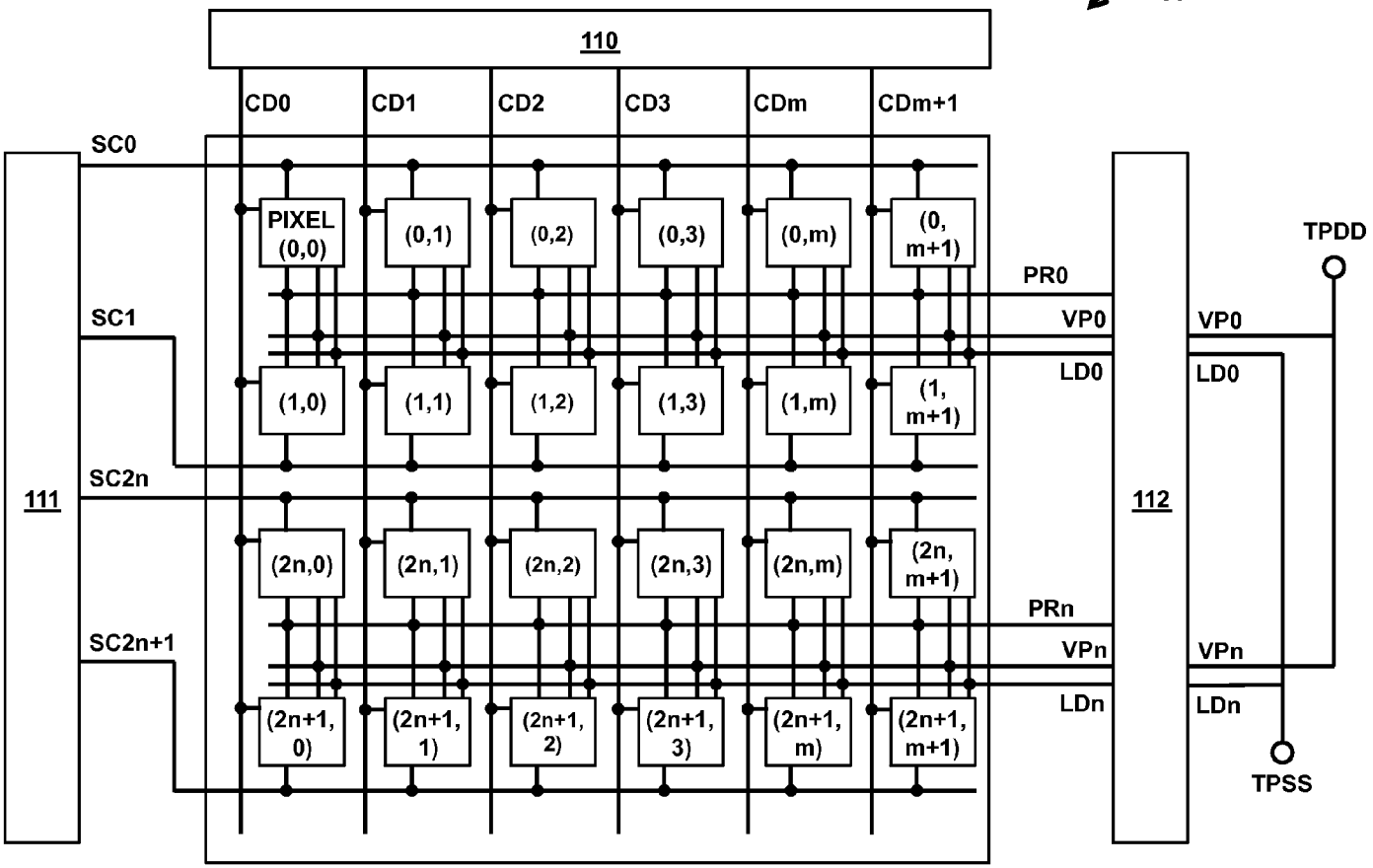
FIG. 5 is a block diagram of a display device according to the present invention.

FIG. 5 shows a block diagram of an embodiment of a display device according to the present invention. In this embodiment, all row-wise preset potential lines VP0-VPn are together connected to a common test point TPDD. Likewise, all row-wise sink potential lines LD0-LDn are together connected to a common test point TPSS.

In other embodiments, the sink potential lines are not brought out to a test point, so that only TPDD is available for external connection. In still other embodiments, the preset potential lines are not brought out to a test point, so that only TPSS is available for external connection. In further embodiments, the preset potential lines are not all connected together, but are connected together in groups of L lines ($1 \le L < 2n+1$), where each group is attached to a respective test point. Having multiple test points allows multiple pixels to be tested simultaneously but independently, speeding up inspection of the display device. In still further embodiments, the sink potential lines are grouped in an analogous manner.

The test procedure will be described in the context of an embodiment having an external test point TPDD, and no external test point corresponding to the sink potential lines. It will be clear to one skilled in the art how this method may be extended to use just a TPSS test point, both a TPDD test point and a TPSS test point, multiple preset potential test points, or multiple sink potential test points.

Figure 7:
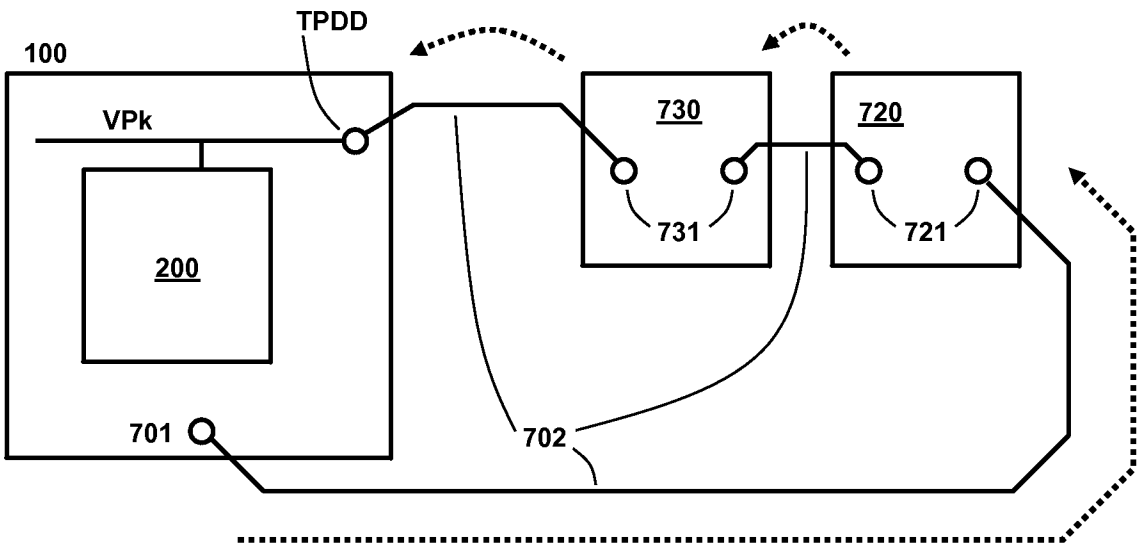
FIG. 7 is a block diagram of an equipment configuration for an inspection method according to the present invention.

FIG. 7 shows a display device 100 having a test point TPDD connected to preset potential line VPk, which in turn is connected to pixel circuit 200. Display device has another terminal 701 which is a ground reference terminal. Display device 100, ammeter 730, and external power supply 720 are connected in a single loop using interconnect wires 702. 731 and 721 indicate terminals of the ammeter 730 and the external power supply 720 respectively.

When powered and configured, current flows from the external power supply, through the ammeter and the display device in series, and returns to the external power supply. Dotted lines in FIG. 7 indicate the current flows external to display device 100.

Thus a potential is provided to the preset potential line connected to TPDD. A potential is provided to the sink potential line through an internal connection from the sink potential line to a sink potential power supply. Depending on the stage of manufacture of the display device being tested, the sink potential power supply may be part of the display device, or may be separately provided through a testing harness (not shown) as is well known in the art. Likewise, the signal lines and scanning lines may be controlled by built-in circuitry of the display device, or they may be controlled externally through a testing harness. In some embodiments, one or more test points TPDD, TPSS may also be incorporated into the testing harness. A potential is applied to first power supply line VDD so that all diode-connected transistors are biased to a non-conducting state.

Figure 8:
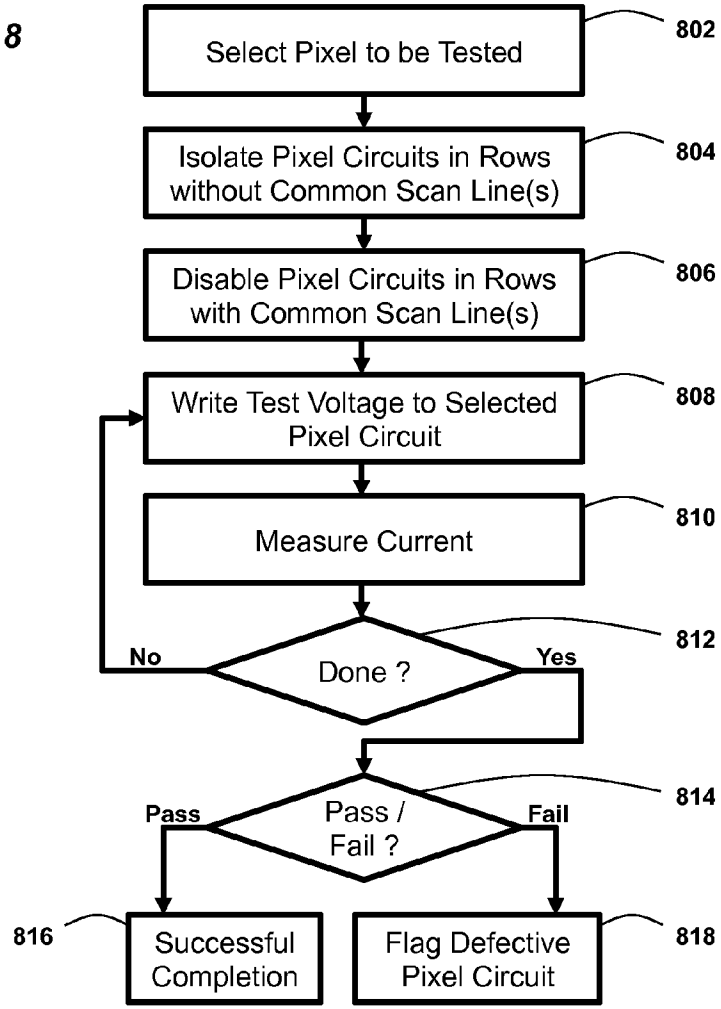
FIG. 8 is a flowchart of a method for testing a pixel circuit.

FIG. 8 depicts an embodiment of a method for testing a single pixel circuit. It is assumed for the purpose of this example that the test procedure is being carried out prior to fabrication of the light emitting elements of the display device, so there is no possibility of a current path from any driving transistor to the second power supply line VEE.

Figure 6A:
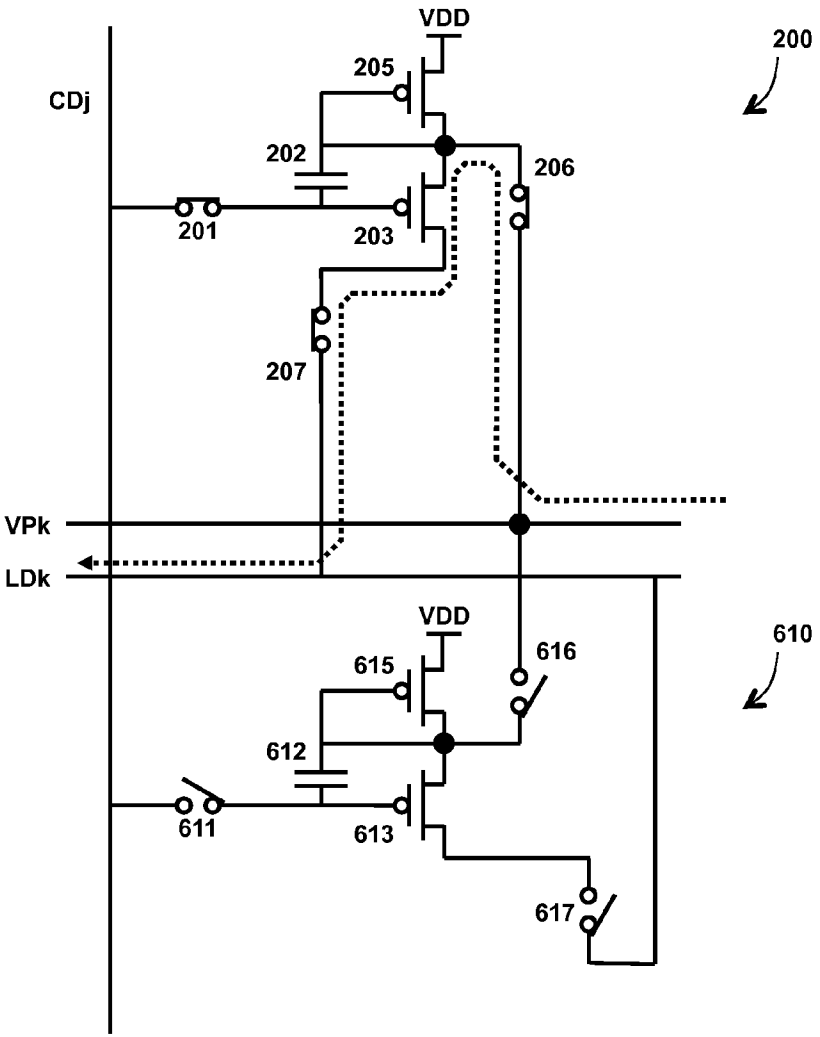
FIGS. 6A-6B are explanatory diagrams of the present invention.

Initially at step 802, a first pixel circuit 200 (associated with a first pixel) is chosen to be tested. For rows not sharing scan lines with the first pixel circuit 200, at least one of the corresponding second line and the third scanning line are configured to place at least one of the corresponding switching transistor and the corresponding shunt transistor for each pixel into a non-conducting state, so that none of the pixel circuits in these rows provides a current path between the preset potential line and the sink potential line. Thereby (step 804) pixel circuits in these rows are isolated. FIG. 6A shows pixel circuit 610 controlled by different scanning lines than pixel circuit 200. The elements 611, 612, 613, 615, 616, and 617 of pixel circuit 610 are respectively analogous to the elements 201, 202, 203, 205, 206, and 207 of pixel circuit 200 described above. Switching transistor 616 and shunt transistor 617 are set to respective non-conducting states. No light emitting element is present.

Figure 6B:
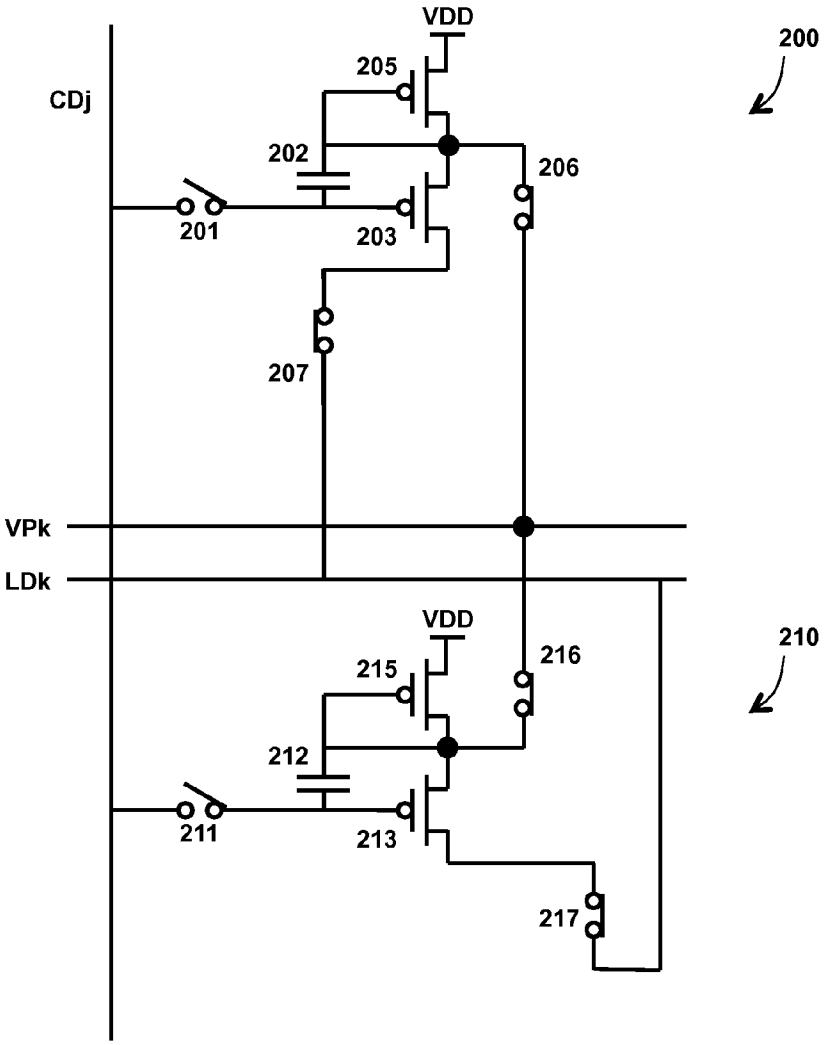

Then, for rows that do share one or more scan lines with the first pixel circuit 200, the scan lines and signal lines are controlled to write a second voltage to the storage capacitor of each pixel circuit in these rows. This second voltage is chosen so that the driving transistor associated with an instant storage capacitor is biased below threshold. Thereby all pixel circuits in these rows, with the possible exception of the first pixel circuit 200, are set to a state where the driving transistor is in a non-conducting state, and these pixel circuits do not provide a current path between the preset potential line and the sink potential line. Thereby (step 806) these pixel circuits are disabled. FIG. 6B shows pixel circuit 210 controlled by one or more scanning lines shared with pixel circuit 200. Switching transistor 216 and shunt transistor 217 may be in a conducting state, but sampling transistor 211 has been put in a non-conducting state after writing a voltage V212 across storage capacitor 212 that sets driving transistor 213 in a non-conducting state, i.e. $V212<V_{TH,213}$. No light emitting element is present.

The skilled practitioner will recognize that steps 802, 804, and 806 may be performed in a different order. For example, steps 804 and 806 may be interchanged. Also, much or all of steps 804 and 806 may already have been performed before step 802, for a previously tested pixel circuit. That is, after step 802, only zero, one, or a few pixel rows may need to be isolated at step 804, and only one pixel may need to be disabled at step 806.

Then at step 808, a desired test voltage is applied to the storage capacitor 202 of the first pixel circuit 200, and the switching transistor 206 and shunt transistor 207 are both set to respective conducting states. Depending on the relation between the voltage across the storage capacitor 202 and the threshold voltage of the driving transistor 203, this may lead to current flow internal to the display device through driving transistor 203, and the same current flows externally through the ammeter, whence (step 810) the current is measured. A dotted line in FIG. 6A shows the path of internal current flow through pixel circuit 200. Through the procedure described above, in this embodiment only pixel circuit 200 contributes to the externally measured current.

In this embodiment, a sequence of test voltages is applied to the first pixel circuit. Thus, at step 812, the "No" branch is taken until currents have been measured for each of the test voltages in the sequence. By applying a sequence of test voltages to the storage capacitor 202, the I-V characteristic of the driving transistor 203 can be determined. This I-V characteristic can be compared against a window of acceptable response, and a ready determination can be made whether the driving transistor 203 is acceptable (Pass) or defective (Fail), as indicated at step 814. Alternatively, a threshold voltage $V_{TH,203}$ can be determined from the I-V characteristic, and this measured threshold voltage can be compared against test limits to determine whether the driving transistor 203 is acceptable or defective. In order to speed up the test procedure, the sequence of test voltages can be terminated early at step 812, if a single measurement point is found to be outside predetermined limits for that point. In some embodiments, the sequence of test voltages can be dynamically varied according to preceding measurements.

If a determination of an acceptable pixel circuit is made at step 814, the Pass branch is taken, and the test method of FIG. 8 is successfully completed (step 816).

In this case, the test described above can be repeated sequentially for other pixel circuits of the display device, so as to cover all the pixels of the display device. Alternatively, testing may be configured to cover a sample or a subset of the pixel circuits.

When a defective pixel circuit is found, the Fail branch is taken at step 814, whereupon different actions can be taken. The embodiment of FIG. 8 shows the defective circuit being flagged at step 818. In some embodiments, testing may be configured to stop upon detection of a predetermined number of defective pixel circuits. This predetermined number may be 1 in some embodiments, and may be greater than 1 in other embodiments. In some embodiments, a pixel circuit flagged as defective can be calibrated or compensated downstream, and the manufacturing process can proceed normally. If the defective pixel circuit is on a mother substrate that will later be singulated into multiple discrete panels associated with respective display devices, then the panel containing the defective pixel circuit can be flagged as defective and discarded after singulation. Alternatively, the entire substrate containing the defective pixel circuit can be withdrawn from the manufacturing line. In some embodiments, repair of the defective pixel may be undertaken.

Figure 9:
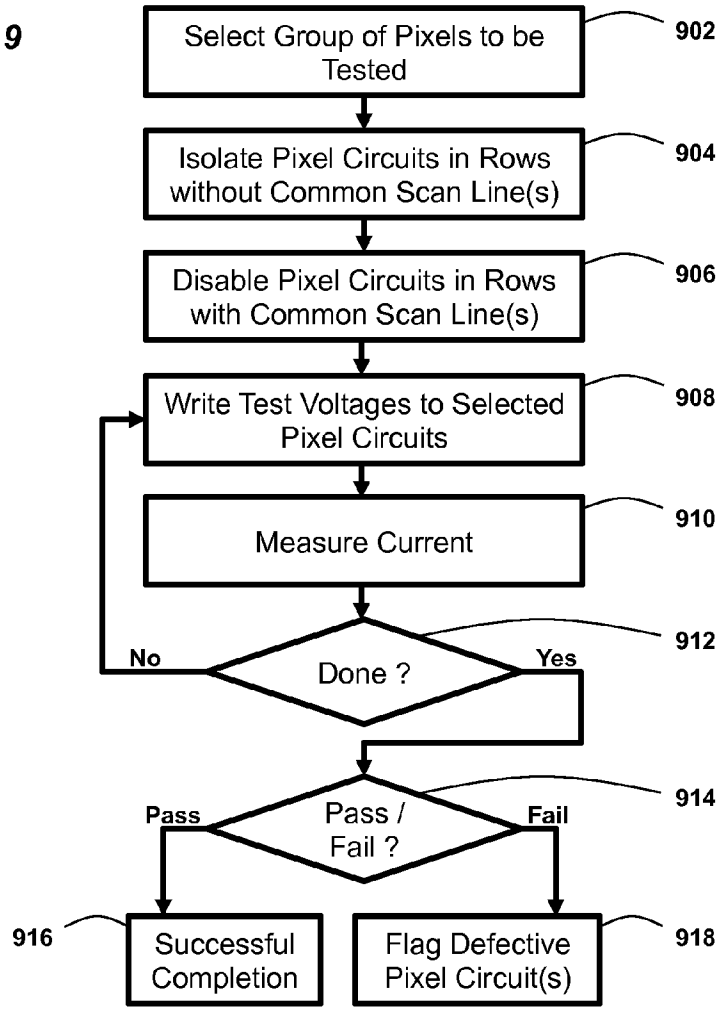
FIG. 9 is a flowchart of a method for testing a group of pixel circuits.

FIG. 9 depicts a method for testing a group of pixel circuits in another embodiment. The method is similar to that described above for the embodiment of FIG. 8. Hence, only the differences will be described here. At step 902, a group of pixels is selected to be tested together. At step 904, only those rows are isolated which have no scan lines in common with any of the pixel circuits of the selected pixel group. At step 906, pixel circuits are disabled in those rows having one or more scan lines in common with at least one of the pixel circuits of the selected pixel group. At step 908, same or different voltages can be written to the pixel circuits of the selected pixel group. The corresponding currents are measured at step 910. In some embodiments, these currents are summed. In other embodiments these currents are measured at separate test points.

In some embodiments, portions of the I-V curve may be measured in common (that is, by summing currents of all pixel circuits of the selected pixel group), while other portions of the I-V curve may be measured sequentially for each pixel of the selected pixel group, with other pixels of the selected pixel group disabled. In this manner, a balance is achieved between fast testing (by summing currents of identically driven pixel circuits), and accurate characterization of individual pixels (by measuring pixel currents one at a time). At step 912, the test sequence can be dynamically adapted according to the measured currents from preceding test voltages.

Steps 914 and 916 are substantially similar to steps 814 and 816 of FIG. 8 described previously. At step 918, some embodiments flag the entire group of pixel circuits as defective. Other embodiments do at least a portion of the test voltage sequence different for different pixel circuits of the selected group, and may be able to flag a sub-group of the selected group, or even a single pixel circuit as defective at step 918.

It will be apparent to one skilled in the art that other variations in the test procedure as described above can be made without departing from the spirit and scope of the invention. For example, a similar test procedure may also be performed after the light emitting elements have been fabricated, and after manufacture of the display device is complete. The test point may also be used to test groups of pixels together, rather than one pixel at a time. In embodiments having multiple test points, multiple pixel circuits may be tested simultaneously, thereby shortening the time required for inspection of a display device.

In a preferred embodiment, the invention is employed in an emissive display that includes Organic Light Emitting Diodes (OLEDs) which are composed of small molecule or polymeric OLEDs as disclosed in but not limited to U.S. Pat. No. 4,769,292, issued Sep. 6, 1988 to Tang et al., entitled "Electroluminescent Device with Modified Thin Film Luminescent Zone" and U.S. Pat. No. 5,061,569, issued Oct. 29, 1991 to VanSlyke et al., entitled "Electroluminescent Device with Organic Electroluminescent Medium". The manufacture of TFT circuitry is described, for example, in U.S. Pat. No. 5,550,066, issued Aug. 27, 1996 to Tang et al., entitled "Method of fabricating a TFT-EL pixel", and references cited therein. Many combinations and variations of OLED materials and architectures and TFT materials and architectures are available to those knowledgeable in the art, and can be used to fabricate an OLED display device according to the present invention.

All U.S. patents and patent application publications referenced in this specification are hereby incorporated by reference as if set forth in full.

The invention has been described in detail with particular reference to certain preferred embodiments thereof, but it will be understood that variations and modifications can be effected within the spirit and scope of the invention.

The invention claimed is:

1. A pixel circuit comprising:

a sampling transistor having a gate electrode controlled by a first scanning line and a second electrode connected to a signal line;

a driving transistor having a gate electrode connected to a third electrode of the sampling transistor, and having a source electrode and a drain electrode;

a light emitting element connected between a drain electrode of the driving transistor and a first power supply line and driven by current supplied from the driving transistor;

a storage capacitor connected between the gate and source electrodes of the driving transistor;

a switching transistor having a gate electrode controlled by a second scanning line, a second electrode connected to the source electrode of the driving transistor, and a third electrode connected to a preset potential line;

a diode-connected transistor having gate and second electrodes connected to the source electrode of the driving transistor and a third electrode connected to a first second power supply line; and a shunt transistor having a gate electrode controlled by a third scanning line, a second electrode connected to the drain of the driving transistor, and a third electrode connected to a sink potential line.

2. The pixel circuit of claim 1, wherein the first scanning line and the third scanning line are the same.

3. The pixel circuit of claim 1, wherein the third scanning line and the sink potential line are the same.

4. A display device having a plurality of pixels arranged in a matrix, comprising:

a plurality of signal lines;

a signal line driving circuit for driving the plurality of signal lines;

a plurality of first scanning lines;

a first scanning line driving circuit for driving the plurality of first scanning lines;

a plurality of second scanning lines;

a second scanning line driving circuit for driving the plurality of second scanning lines;

a plurality of third scanning lines;

a third scanning line driving circuit for driving the plurality of third scanning lines;

at least one preset potential line for supplying a preset potential;

at least one sink potential line for supplying a sink potential; and each of the plurality of pixels further comprising:

a sampling transistor having a gate electrode controlled by the one of the plurality of first scanning lines and a second electrode connected to one of the plurality of signal lines;

a driving transistor having a gate electrode connected to a third electrode of the sampling transistor, and having a source electrode and a drain electrode;

a light emitting element connected between a drain electrode of the driving transistor and a first power supply line and driven by current supplied from the driving transistor;

a storage capacitor connected between the gate and source electrodes of the driving transistor;

a switching transistor having a gate electrode controlled by a second scanning line, a second electrode connected to the source electrode of the driving transistor, and a third electrode connected to the at least one preset potential line;

a diode-connected transistor having gate and second electrodes connected to the source electrode of the driving transistor and a third electrode connected to a second power supply line; and a shunt transistor having a gate electrode controlled by a third scanning line, a second electrode connected to the drain of the driving transistor, and a third electrode connected to the at least one sink potential line.

5. The display device of claim 4, wherein the plurality of first scanning lines and the plurality of third scanning lines are the same, and wherein the first scanning line driving circuit and the third scanning line driving circuit are the same.

6. The display device of claim 4, wherein the sink potential line connected to the third electrode of the shunt transistor of one of the plurality of pixels is the same as the third scanning line connected to the second electrode of the same shunt transistor.

7. The display device of claim 4, wherein the second scanning lines are arranged in a row direction of the matrix of pixels, and one second scanning line is shared by two adjacent rows.

* * * * *